US005287921A

United States Patent [19]

Blount et al.

[11] Patent Number: 5,287,921

[45] Date of Patent: Feb. 22, 1994

[54] METHOD AND APPARATUS FOR SETTING A WHIPSTOCK

[76] Inventors: Curtis G. Blount, 251 Gail Dr., Wasilla, Ak. 99654; Charles M. Hightower, 641 Post Oak Dr., Plano, Tex. 75025; Charles D. Hailey, 1661 Exchange Ave., Oklahoma City, Okla. 73108

[21] Appl. No.: 2,555

[22] Filed: Jan. 11, 1993

[51] Int. Cl.[5] ..... E21B 19/00; E21B 7/06; E21B 23/03

[52] U.S. Cl. ..... 166/117.6; 166/384

[58] Field of Search ..... 166/384, 385, 117.5, 166/117.6

[56] References Cited

U.S. PATENT DOCUMENTS

| | | | |
|---|---|---|---|
| 4,397,355 | 8/1983 | McLamore | 166/297 |
| 4,844,157 | 7/1989 | Taylor | 166/178 |
| 5,113,938 | 5/1992 | Clayton | 166/250 X |
| 5,139,086 | 8/1992 | Griffith | 166/178 |
| 5,180,012 | 1/1993 | Crawford | 166/381 X |
| 5,211,715 | 5/1993 | Braden et al. | 175/58 |
| 5,222,554 | 6/1993 | Blount et al. | 166/117.6 |

*Primary Examiner*—Ramon S. Britts
*Assistant Examiner*—Roger J. Schpeppel
*Attorney, Agent, or Firm*—Roderick W. MacDonald

[57] ABSTRACT

A method and apparatus for setting a whipstock in a subsurface well conduit using a combination of an accelerator tool, jar tool, and setting tool, and a whipstock being shearingly carried by the setting tool, and using the jar tool to shear and separate the whipstock from the setting tool.

10 Claims, 4 Drawing Sheets

METHOD AND APPARATUS FOR SETTING A WHIPSTOCK

BACKGROUND OF THE INVENTION

In subterranean well operations, it is necessary from time to time to set a whipstock in a subsurface well conduit such as a tubing string or a well casing. The whipstock is set to deviate a mill bit or a drill bit away from the longitudinal axis of the conduit to mill a window in the conduit from which to drill a deviated well bore at an angle to the longitudinal axis of the conduit.

The cost and time consumed in using a conventional rotary drilling rig in the foregoing situation is considerable and there has been a trend towards the use of coiled tubing units for these and other well operations heretofore conducted with conventional (jointed straight pipe) drilling rigs.

Coiled tubing units are known in the art, but not widely used in the field yet. Coiled tubing units are nevertheless available on a commercial basis. Inventions such as that disclosed herein will render coiled tubing units more readily useful in the field by reducing both the cost and time expenditure, as compared to a conventional drilling rig, for a given operation.

Heretofore, tools and procedures have been developed for use with conventional drilling rigs for various operations such as removing (milling) a section of a well conduit, whether it is tubing or casing, but these tools and procedures cannot be transferred unchanged to a coiled tubing unit and employed successfully in the same manner as employed in the conventional drilling rig. The use of conventional drilling rig tools and procedures in a coiled tubing context has several shortcomings. For example, control over the axial downward pressure on the tool or tools employed downhole is difficult to maintain because of the flexibility of the coiled tubing string. Accordingly, the cutting or milling tool may wear prematurely or unduly cut into other downhole tools such as whipstocks.

SUMMARY OF THE INVENTION

According to this invention there is provided a method and apparatus for setting a whipstock in a subsurface well conduit using a coiled tubing unit.

In accordance with the method of this invention a combination of coiled tubing, accelerator tool, jar tool and setting tool is provided together with the whipstock shearingly attached to the setting tool. The foregoing combination is set on a packer that has been previously set in a predetermined location in the well conduit. The jar is actuated to shear the whipstock from the setting tool and leave the whipstock on the packer while the accelerator is employed to store energy and insulate the coiled tubing from impact of the jar during the shearing-separation step.

The apparatus of this invention comprises, with or without coiled tubing, the combination of an accelerator, jar, setting tool with a shear means, and a whipstock carried by the shear means.

Accordingly, it is an object of this invention to provide a new and improved method and apparatus for setting a whipstock in a subsurface well conduit.

It is another object to provide a new and improved method and apparatus for employing coiled tubing technology together with conventional downhole tools in a unique manner such that all the advantages of a coiled tubing unit can be achieved without the requirement for unique downhole tools.

It is another object to provide a new and improved method and apparatus for setting a whipstock in a subsurface well conduit at significantly reduced cost and time expenditure over conventional rotary rig procedures.

Other aspects, objects and advantages of this invention will be apparent to those skilled in the art from this disclosure and the appended claims.

DETAILED DESCRIPTION

Figure 1:
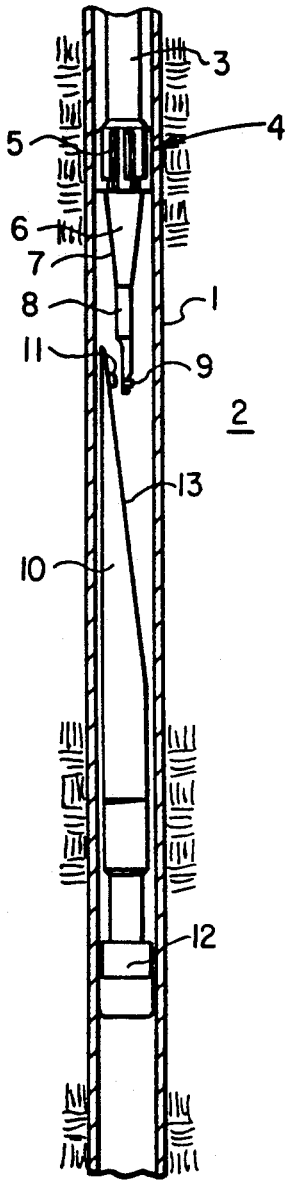
FIG. 1 (PRIOR ART)
FIGS. 1, 2, and 3 show a conventional rotary rig prior art process for setting a whipstock and forming a window in a subsurface well conduit.

Referring to FIG. 1, there is shown a conventional subsurface well conduit 1 which in the case of FIG. 1 is casing 1. Casing 1 lines a wellbore that has been drilled into earth 2 a finite distance. At the earth's surface (not shown) a conventional rotary drilling rig (not shown) employs a conventional jointed tubing string 3 which is composed of a plurality of straight sections of pipe joined to one another by conventional coupling means at the bottom of which is carried starting mill 4. Starting mill 4 is composed of a cutting head 5 that is designed to cut through casing 1. Below head 5 extends a frustoconical member 6 having a sloping wear surface 7. Member 6 carries at its lower end a sub 8 which is adapted at its lower end to carry shear pin 9. Shear pin 9 is connected to whipstock 10 through wear projection 11. Wear projection 11 is often referred to in the art as a wear pad or wear lug and remains as a fixed projection on guide surface 13 after pin 9 is sheared and sub 8 separated from whipstock 10. Whipstock 10 is connected to and rests upon a conventional pack-off 12.

Whipstocks normally have a guide surface 13 which cuts across the long axis of the wellbore and well conduits therein such as casing 1. Wear surface 7 bears on projection 11 to direct millhead 5 against casing 1 after shear pin 9 is sheared. Thus, in operation, the assembly of tools from reference numeral 5 through reference numeral 10 are set down on packer 12 in one trip into the wellbore or hole and after whipstock 10 is suitably engaged with packer 12, shear pin 9 is sheared by additional workstring weight transmitted through tubing 3 from the drilling rig at the surface of the earth. Wear projection 11 being formed on guide surface 13 so that it remains after shear pin 9 is sheared, further movement downward of starting mill 4 caused by the lowering of tubing 3 and engagement of sloped surface 7 with wear projection 11 forces millhead 4 away from guide surface 13 against casing 1 to form the desired window 15 (FIG. 2) in casing 1. The result of such operation is shown in FIG. 2 which shows millhead 5 to have cut window 15 in casing 1.

Figure 2:
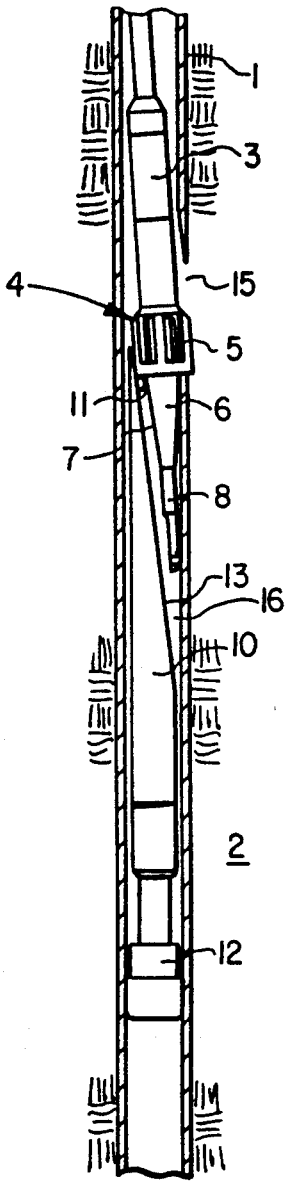
FIG. 2 (PRIOR ART)
Figure 3:
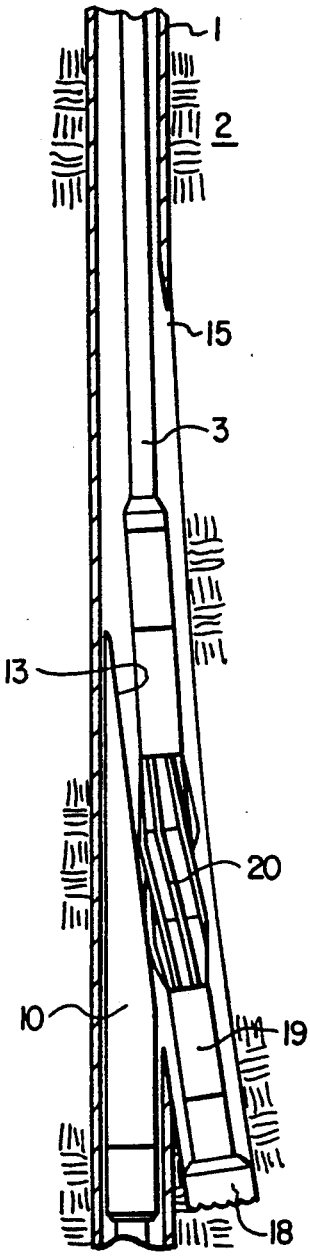
FIG. 3 (PRIOR ART)

FIG. 3 shows the next prior art step after initial window formation of FIGS. 1 and 2. FIG. 3 involves enlarging window 15 by use of window mill 18 which is connected by way of sub 19 to a watermelon shaped mill 20 all of which are carried at the bottom of tubing string 3 and operated from the earth's surface by way of the rotary table (not shown) on a conventional drilling rig at the earth's surface. The window mill 18 can be a diamond speed mill, crushed carbide mill or the like.

Additional savings can be realized by the practice of the method of this invention when it is employed through tubing already existing inside casing in a wellbore because this invention can be practiced through tubing without the necessity of removing that tubing from the wellbore before an operation such as window milling is formed in the casing. It should be understood, however, that this invention is not limited to through-tubing applications, but can be employed in production tubing itself or in wells where tubing is not present inside the casing.

Figures 4A, 4B:
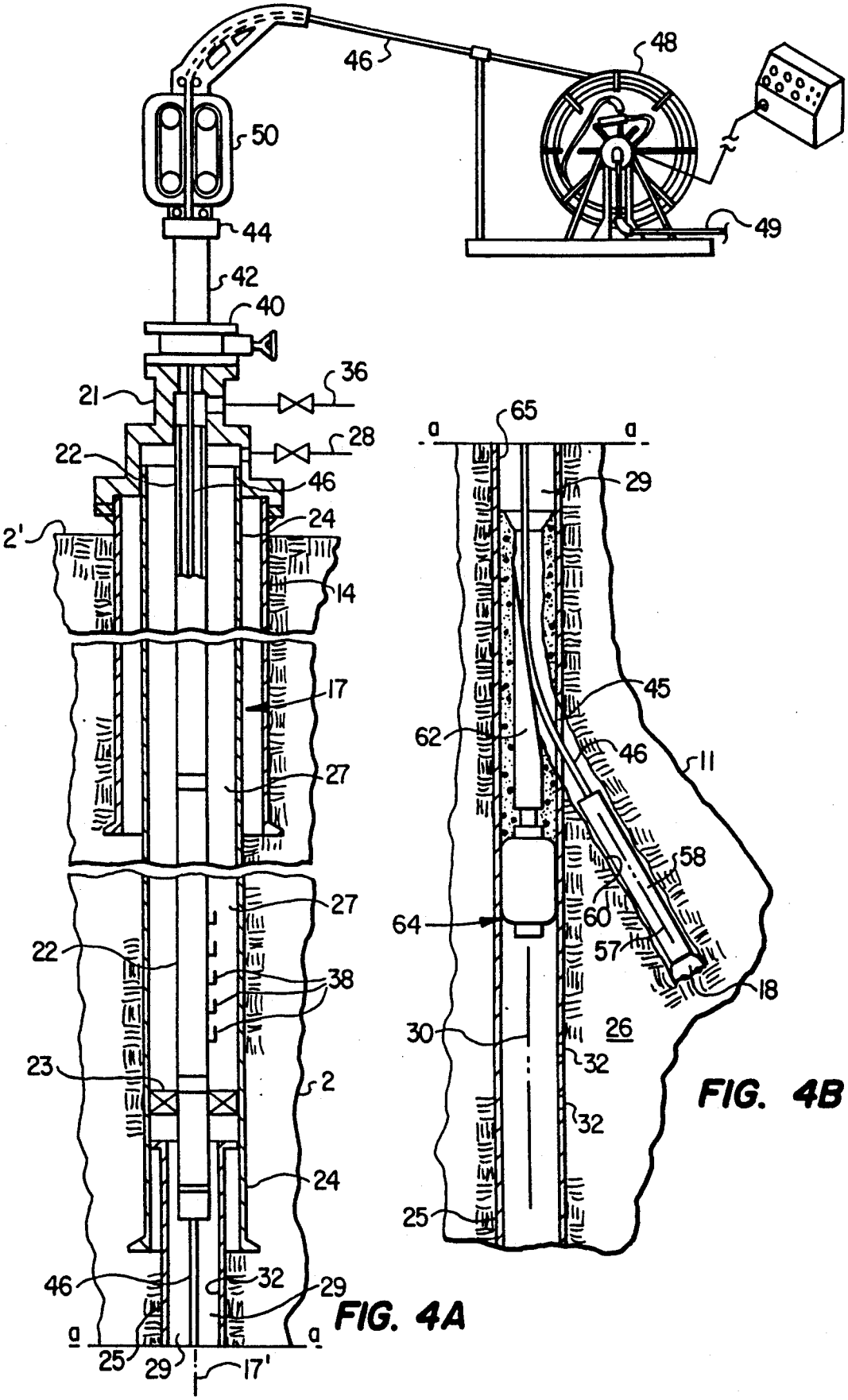
FIGS. 4A and 4B show one embodiment of the use of coiled tubing apparatus after setting a whipstock in accordance with this invention.
Figure 8:
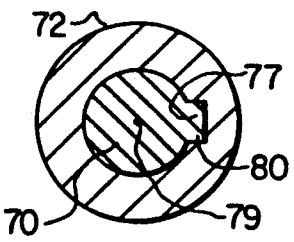
FIGS. 5 through 8 show the use of a whipstock in a window formation procedure.

Referring now to FIGS. 4A and 4B, there is shown a cross section of an oil and gas production well, generally designated 17, whose longitudinal axis 17' extends downwardly into earth 2 from the surface 2' thereof. Well 17 includes a conventional surface casing 14, an intermediate casing string 24, and a production liner or casing 25 extending into a subsurface oil and gas producing zone 26. A conventional wellhead 21 is connected to casing strings 14 and 24 and is also suitably connected to production tubing string 22 extending within casing 24 and partially within casing 25. A suitable seal 24 is formed in the wellbore between tubing 22 and casing 24 by packer 23 or the like, thereby defining an annulus 27 between casing 24 and tubing 22. The well is adapted to produce fluids from zone 26 through suitable perforations 32 formed in production casing 25 at desired intervals. Produced fluids flow through production tubing 22 to production flow line 36 for storage, treatment, transporting, or the like. The well structure as described to this point is conventional and well known to those skilled in the art.

However, in accordance with this invention, wellhead 20 is not superimposed at earth's surface 2' by a conventional rotary drilling rig. Instead, wellhead 20 is provided with a conventional crown valve 40 and a lubricator 42 mounted on crown valve 40. Lubricator 42 includes a stuffing box 44 through which may be inserted or withdrawn a coilable metal tubing string 46 (coiled tubing) which, in FIGS. 4A and 4B, is shown extending through tubing string 22 into casing 25 and diverted by a whipstock 62 set on packer 64 through a window 45 in casing 25 (FIG. 4B). Tubing string 46 is adapted to be inserted into and withdrawn from the interior space of tubing 22 by way of a tubing injection unit 50 which is well known in the art. Tubing string 46 is normally coiled onto a storage reel 48 of the type described in further detail in U.S. Pat. No. 4,685,516 to Smith et al. Lubricator 42 is conventional in configuration and permits the connection of certain tools to the downhole end of tubing string 46 for insertion into and withdrawal from wellbore space 29 by way of coiled tubing 46.

If desired, produced fluid flowing into the interior of production tubing 22 can be artificially lifted to flow line 36 by injecting gas by way of flow line 28 into annulus 27 which then flows into the interior of tubing 22 by way of gas lift valves 38.

Window 45 in casing 25 of FIG. 4B is formed by operation of a combination of downhole motor 58 and window mill 18 as will be described in greater detail hereinafter, motor-mill combination 58-18 being carried by coiled tubing 46. Both motor 58 and window mill 18 are of conventional construction commercially available to those skilled in the art. The motor-mill combination 58-18 is of a diameter small enough to be passed through the interior of tubing 22.

Motor 58 is driven by pressure fluid from the earth's surface 2' to rotate mill 18 to form window 45. Such pressure fluid, e.g., water, water with polymer additives, brine, or diesel fuel including additives, or other fluid including nitrogen or air, is supplied from a source (not shown) by way of conduit 49 and reel 48 to be pumped down through the interior of coiled tubing 46 and thereby operate motor 58. Such pressure fluid also serves as a cuttings evacuation fluid while forming window 45. As shown in FIG. 4B, coiled tubing string 46 has been diverted into the direction illustrated by whipstock 62 which is positioned in the interior space 29 of casing 25.

Referring to FIG. 4B, as well as FIGS. 5 through 8, whipstock 62 is set in place pursuant to this invention to provide, for example, for formation of window 45. Whipstock 62 is carefully oriented when set onto packer/anchor 64 so as to give the desired direction to side bore 60. A conventional inflatable or mechanical packer 64 is conveyed into the interior space 29 of the wellbore and set in the position shown within casing 25 by passing the packer through the interior of tubing string 22 on the downhole end of coiled tubing 46. Packer 64 can also be of any conventional configuration, including setting mechanism, similar to that described in U.S. Pat. No. 4,787,446 to Howell et al. Coiled tubing string 46 is released from packer 64 once it is set in the position shown by utilizing any desirable and well known coupling system such as that described in U.S. Pat. No. 4,913,229 to D. Hearn.

Whipstock 62 includes an elongated guide surface 68 formed thereon. Guide surface 68, according to this invention, may or may not carry a wear projection such as projection 11 of FIGS. 1 and 2.

Figure 6:
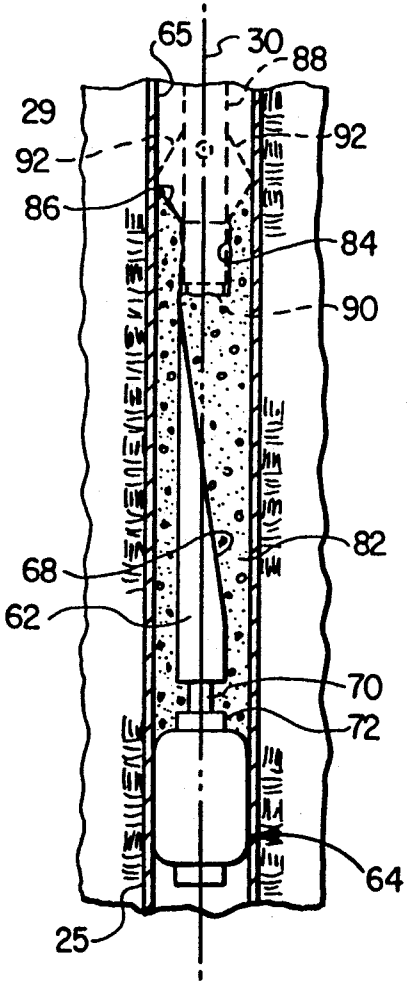
Figure 5:
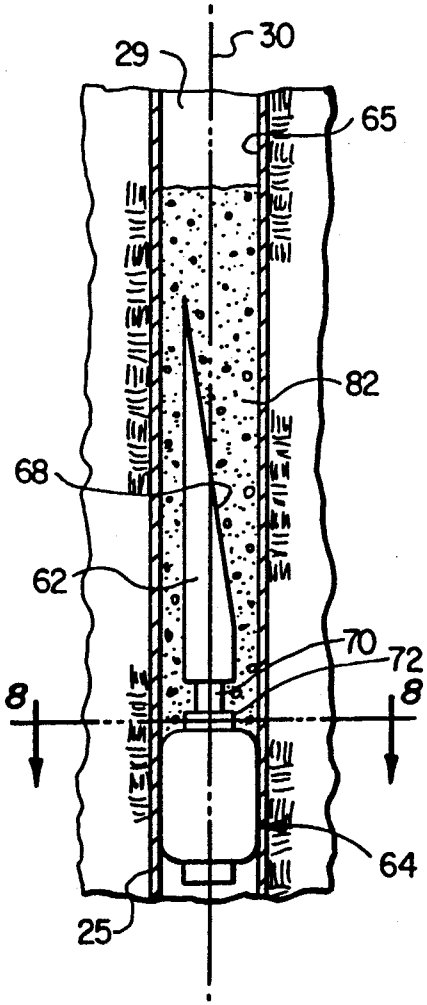

Whipstock 62 includes a shank portion 70 which is insertable within a mandrel 72. Mandrel 72 is part of packer 64. Orientation of whipstock 62 is carried out utilizing conventional methods. For example, mandrel 72 may be provided with a suitable key way 77, FIG. 8, formed therein. Upon setting packer 64 in casing 25 a survey instrument is lowered into the wellbore to determine the orientation of key way 77 with respect to reference point and longitudinal axis 79. Whipstock shank 70 is then formed to have a key portion 80, FIG. 8, positioned with respect to guide surface 68 such that upon insertion of whipstock 62 into mandrel 72 key 80 would orient surface 68 in the preferred direction with respect to longitudinal axes 17 and 30. Upon setting whipstock 62 in the position shown in FIG. 5, a quantity of cement 82 is injected into casing 25 by conventional methods, including pumping the cement through coiled tubing 46, to encase whipstock 62 as shown. Once cement 82 is set, a pilot bore 84 is formed in cement 82 as indicated in FIG. 6, said bore including a funnel-shaped entry portion 86. Bore 84 and funnel-shaped entry portion 86 can be formed using a cutting tool 88 having a pilot bit portion 90 and retractable cutting blade 92 formed thereon. Cutting tool 88 may be of any conventional type such as that disclosed in U.S. Pat. No. 4,809,793 to C. D. Hailey, which describes a tool that can be conveyed on the end of a coiled tubing string such as string 46, and rotatably driven by a downhole motor similar to motor 58 to form pilot bore 84 and entry portion 86. Pilot bore portion 84 is preferably formed substantially coaxial with longitudinal axis 30 of casing 25 and 17' of the wellbore.

Figure 7:
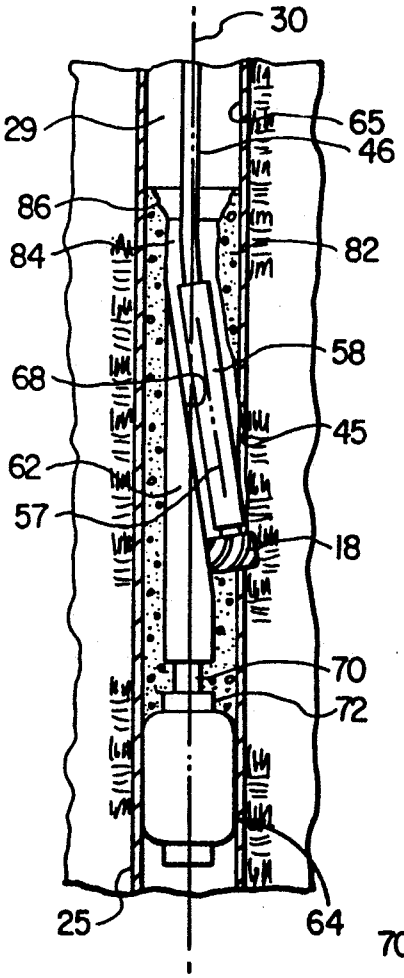

Upon formation of pilot bore 84, tool 88 is withdrawn from the wellbore through tubing string 22 and replaced by the aforesaid combination of downhole motor 58 and mill 18. Mill 18 is directly connected to motor 58 so that operation of motor 58 by way of fluid being pumped through the interior of coiled tubing 46 rotates mill 18. Motor-mill combination 58-18 is lowered on coiled tubing 46 into the wellbore through tubing string 22 until it reaches pilot bore 84. At least by that time, pressure fluid is supplied through the interior of coiled tubing 46 to operate motor 58 thereby rotating mill 18 to begin milling out a portion of cement plug 82 and the wall of casing 25 to form window 45 as shown in FIG. 7.

The milling operation is continued until mill 18 has formed window 45 whereupon coiled tubing string 46 is withdrawn through tubing string 22 until motor 58 and mill 18 are in lubricator 42. Mill 18 can then be removed and replaced by a dressing mill such as watermelon mill 20, if desired, for smoothing and otherwise dressing window 45 by operation of the larger dressing mill 20. Dressing mill 20 is lowered to window 45 at the end of tubing 46 in the same manner as shown in FIG. 3 for straight tubing 3. Dressing mill 20 is then rotated by way of motor 58 as described hereinabove with respect to speed mill 18 through window 45 to dress the edges of window 45 for ease of passage of tools through that window during subsequent well operation using coiled tubing 46 after motor 58 and dressing mill 20 have been removed.

Figure 9:
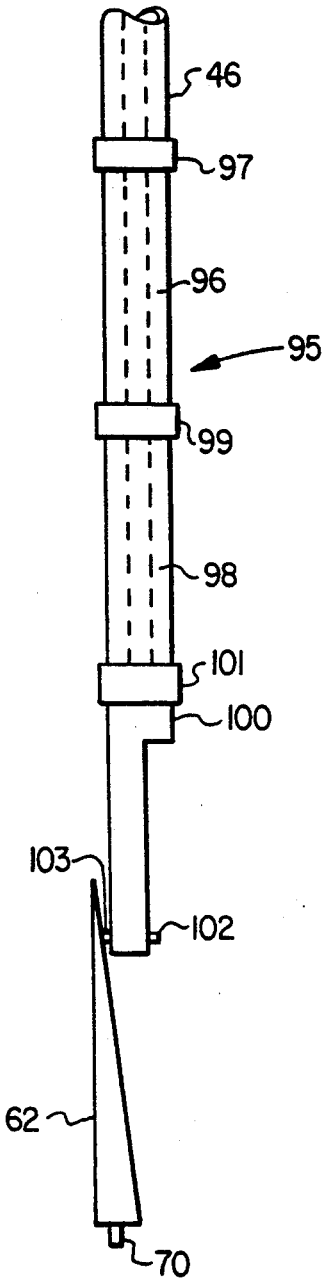
FIG. 9 shows one embodiment of apparatus within the invention.

In accordance with this invention, FIG. 9 shows one embodiment of apparatus 95 which is within this invention and is carried at the end of coiled tubing 46 before whipstock 62 is placed onto packer 64 as described hereinabove. Apparatus combination 95 is composed of an accelerator tool 96 which is connected to coiled tubing 46 by way of coupling means 97. Accelerator tool 96 carries jar tool 98 by means of coupling means 99, although a weight bar can be interposed between the two if desired to enhance the jar's impact. Setting tool 100 is carried by jar tool 98 by coupling means 101. Setting tool 100 removably carries whipstock 62 by means of shear means 102. Accordingly, the apparatus of this invention includes the combination of elements 96, 98, 100, 102, and 62 with or without coiled tubing 46.

Accelerator tool 96 is a conventional piece of apparatus commercially available to those skilled in the art and serves as an energy storage device to maximize jar effectiveness and as a shock absorber to insulate the drillstring from shock loads that may be encountered by apparatus carried at the bottom of the drillstring. Thus, accelerator tool 96 is employed to store energy and insulate coiled tubing 46 from any shock load that may be generated by jar tool 98 as will be discussed hereinafter. Any commercially available accelerator tool can be employed, a particularly suitable tool being the commercially available double acting hydraulic tool or nitrogen gas charged accelerator tool.

Figure 14:
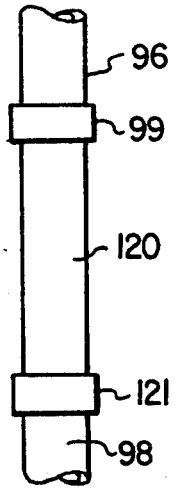
FIG. 14 shows another embodiment within this invention wherein a weight bar is employed for enhancing the jarring impact.

Jar tool 98 also is a conventional piece of equipment available commercially which is designed to be set and then upon proper actuation when in the location desired in the wellbore deliver, pursuit to surface control, a jarring impact either up, down, or both up and down a drillstring. The jarring action can be initiated by tension on the drillstring or weight on the drillstring depending on the type of tool employed, the ultimate requirement simply being that a jarring impact is generated by control exerted at the earth's surface through coiled tubing 46. Again, any commercially available jar tool can be employed, one preferable tool being the commercially available double acting hydraulic drilling jar. In operation, jar tool 98 is cocked or otherwise set before or after tool combination 95 is put into the wellbore at the end of coiled tubing 46 and then actuated after whipstock 62 is secured onto packer 64 so as to deliver a jarring impact to shear means 102 through setting tool 100 to cause shear means 102 to physically separate thereby separating whipstock 62 from setting tool 101 and allowing the removal of tool combination 95 from the wellbore while leaving whipstock 62 in place on packer 64. During this operation accelerator tool 96 stores energy for the jarring effect and insulates coiled tubing 46 from the jarring impact generated by jar tool 98 when severing shear means 102. If desired, as shown in FIG. 14, weight bar 120 can be employed between accelerator 96 and jar 98 (using couplings 99 and 121) to aid in maximizing the jarring effect.

Setting tool 100 provides an interface between jar tool 98 and whipstock 62 and is designed to carry any desired shear means 102 and the load of whipstock 62, and to withstand the jarring impact generated by jar tool 98. Any design which meets these requirements is suitable for use as setting tool 100. Setting tool 100 is not a piece of equipment that is commercially available, although one skilled in the art being advised of the foregoing requirements and operational goals for setting tool 100 can design and fabricate a suitable setting tool 100.

Setting tool 100 carries at a lower end thereof at least one shear means 102 which is physically strong enough to carry the weight of whipstock 62 as apparatus combination 95 is lowered into the wellbore and down to packer 64, but is weak enough due to the metallurgy or other chemical characteristics of shear means 102 or to mechanical devices such as stress concentrating notches or the like in shear means 102 or combinations thereof so that when jar tool 98 is actuated the impact causes shear means 102 to physically separate into two parts thereby separating setting tool 100 from whipstock 62. Shear means 102 can be any one of a number of well known devices in the art such a simply a shear rod which is welded to setting tool 100, a shear bolt which threadably engages setting tool 100 or is otherwise bolted to that tool, a shear or wear pad which is designed to separate parallel to the longitudinal axis of tool 100 or the like. It is preferable that a stress concentrator 103 such as a groove or circumferential notch in shear means 102 is employed in the space 103 between setting tool 100 and whipstock 62 so that it is a certainty that when shear means 102 separates into two pieces the break occurs between setting tool 100 and whipstock 62. This is shown in greater detail in FIGS. 15 and 16 hereinafter. These are conventional requirements well known to those skilled in the art. This function and obvious equivalents thereto can be readily carried out by one skilled in the art once apprised of the foregoing requirements, and are all included within the scope of this invention.

Figure 10:
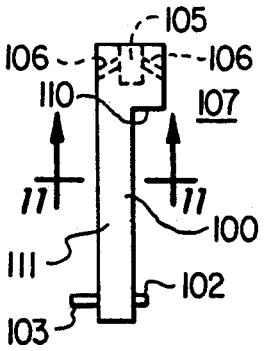
FIG. 10 shows one embodiment of a setting tool within this invention.

FIG. 10 shows one embodiment of a setting tool 100 useful within this invention wherein the setting tool is modified to contain an internal space 105. The body of setting tool 100 also carries at least one aperture 106 which establishes fluid communication between interior space 105 and the exterior 107 to tool 100. Conventional coiled tubing 46 has an open interior space extending the length thereof. Accelerator tool 96 and jar tool 98 can also have a longitudinally extending open space so that coiled tubing 46 and tools 96 and 98 when arranged in the manner shown in FIG. 9 have their interior longitudinal open spaces in alignment to provide an open fluid communication zone from the earth's surface through coiled tubing 46 and tools 96 and 98 into interior space 105 of tool 100. This way fluid can be pumped from the earth's surface through the interior coiled tubing 46 and tools 96 and 98 into interior space 105 and out of space 105 by way of apertures 106 to exterior 107. This way fluid can be circulated through the interior of the equipment to the exterior of the equipment and back to the earth's surface along the exterior of tool combination 95 and coiled tubing 46 to the earth's surface thereby replacing whatever fluid that existed along the exterior of tool combination 95 and coiled tubing 46 with whatever fluid is desired as a replacement fluid. For example, often when a packer such element 64 is set in a well conduit there is left in the wellbore and within the well conduit above packer 64 what is well known in the art as packer fluid. Often times it is desirable to replace the existing packer fluid with a different fluid for a subsequent well operation such as replacing the packer fluid with a drilling fluid and before milling of the window is commenced as described with regard to FIGS. 4B and 7 hereinabove.

Figure 11:
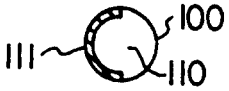
FIG. 11 shows a cross section of the tool of FIG. 10.

FIG. 11 shows setting tool 100 to be circular in configuration with a flat bottom portion 110 from which extends a hemispherical section 111, shear means 102 being fixed to section 111 in any one of a number of ways well known to those skilled in the art some of which have been mentioned hereinabove.

Figure 12:
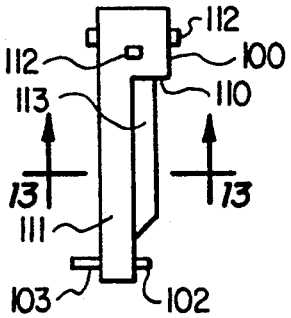
FIG. 12 shows another embodiment of a setting tool within this invention.
Figure 13:
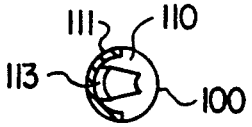
FIG. 13 shows a cross section of the tool of FIG. 12.

FIG. 12 shows another embodiment within the scope of this invention for setting tool 100 wherein centralizing means 112 are spaced around the periphery of tool 100 to keep the tool centered within the well conduit to prevent catching whipstock edges as tool combination 95 is lowered down to packer 64 or pulled out of the hole. In addition, setting tool 100 of FIG. 12 has added thereto reinforcement means 113 which can be added if desired to reinforce section 111 to withstand the rigors of carrying whipstock 62 down to packer 64, subsequent jarring to shear means 102, and then removal of tool combination 95 up through the well conduit to the earth's surface without whipstock 62. Other modifications obvious to those skilled in the art once apprised of the disclosure of this invention will be obvious for various specific applications and are within the scope of this invention.

Figure 15:
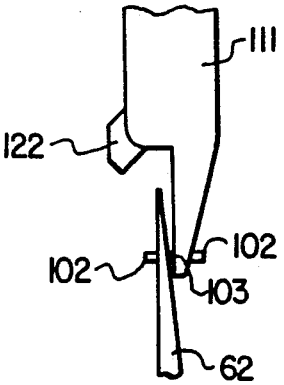
FIG. 15 shows an enlarged section of a setting tool-whipstock interface within this invention.

FIG. 15 shows a preferred embodiment wherein the lower end of section 111 of setting tool 100 carries at least one centralizer 122 for centering tool 100 in the well and for providing a protection as well as stand off function for the important interface between section 111 and whipstock 62 where shear means 102 joins same.

Figure 16:
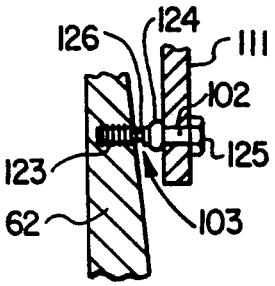
FIG. 16 shows a further enlargement of the interface of FIG. 15.

FIG. 16 shows one of many embodiments within this invention joining section 111 to whipstock 62 in a shearable manner. In this embodiment shear means 102 threadably engages whipstock 62 at 123, has an enlarged region 124 for abutment against section 111, and a threaded nut 125 for fixing shear means rigidly to section 111 between region 124 and nut 125. Space 103 of shear means 102 shows that shear means 102 has a circumferential groove 126 which serves as the stress concentrator that ensures that when sufficiently loaded to a predetermined extent shear means 102 will preferentially and reliably part at groove 126 thereby separating section 111 (and tool 100) from whipstock 62.

In operation, packer 64 or other desirable mechanical anchoring mechanism can be set in the well conduit at the desired location in any of a number of ways well known in the art such as setting by way of coiled tubing 46 or by way of wire line, not shown. Once packer 64 is set, tool combination 95 substantially as shown in FIG. 9 is lowered down to packer 64 by way of coiled tubing 46 and whipstock 62 is locked into and oriented in the manner disclosed hereinabove. After setting and orientation of whipstock 62 in packer 64 jar tool 98 is actuated to sever shear means 102 and separate tool 100 from whipstock 62. Thereafter, if a setting tool of the configuration shown in FIG. 10 is employed, the fluid existing in the well conduit outside of tool combination 95 can be removed and replaced by a desired fluid such a drilling fluid by circulation from the earth's surface through coiled tubing 46 and tool combination 95 through ports 106. Thereafter tool combination 95, without the whipstock, is removed from the wellbore and the wellbore is ready for a subsequent well operation such as milling a window in the wellbore conduit as described hereinabove.

As a further example, after whipstock 62 is locked into packer 64, jar tool 98 can be set by pulling up on coiled tubing 46 and then be actuated by additional tension being applied to coiled tubing 46. If jar tool 98 is designed so that it can be set when X pounds per square inch of tension is imposed on coiled tubing 46 and then actuated when the tension imposed by coiled tubing 46 exceeds X pounds per square inch, jar tool 98, upon such actuation, can be made to deliver a jarring impact to setting tool 100 of 2X pounds per square inch thereby shearing shear means 102 which is designed to shear just above 1100 pounds per square inch. During this operation, accelerator means 96 insulates coiled tubing 46 from the 2X pounds per square inch jarring impact developed by jar tool 98 so that coiled tubing string 46 never sees more than a little over X pounds per square inch even though jar tool 98 is delivering 2X pounds per square inch impact to shear means 102.

When operating with the equipment of this invention as shown in FIG. 9 and in accordance with the method of this invention as described hereinabove, the times required to set whipstock 62 and mill window in the well conduit adjacent and above packer 64 as described hereinabove can be cut at least in half compared to carrying out the same operation with a rotary drilling rig, conventional setting tool, and straight jointed drill string.

Reasonable variations and modifications are possible within the scope of this disclosure without departing from the spirit and scope of this invention.

What is claimed is:

1. In a method for setting a whipstock onto a packer in a wellbore, the improvement comprising providing a coiled tubing injection unit carrying coiled tubing for insertion into a well conduit in said wellbore, providing at one end of said coiled tubing a tool combination comprising an accelerator tool followed by a jar tool followed by a setting tool which setting tool carries said whipstock that is to be set onto said packer, said accelerator tool being connected to said coiled tubing and the remaining tools being carried below said accelerator in the order aforesaid, said whipstock being carried by said setting tool by a shear means, passing said tool combination into said wellbore by said coiled tubing until said whipstock is set on said packer, said jar tool being such that when actuated it delivers a sudden jarring impact to said setting tool, actuating said jar tool after said whipstock is set onto said packer to shear said shear means and physically separate said setting tool from said whipstock, and employing said accelerator tool to enhance said jarring impact on said setting tool and essentially insulate said coiled tubing from said jarring impact.

2. The method according to claim 1 wherein said coiled tubing and tool combination have interconnected internal conduits and said setting tool has at least one aperture thereby to allow fluid to pass through said coiled tubing and tool combination out of said setting tool by way of said at least one aperture and into said wellbore outside said tool combination, and circulating a first fluid through said coiled tubing - tool combination to replace a second fluid already present in said wellbore outside said tool combination.

3. The method according to claim 2 wherein said first fluid is drilling fluid and said second fluid is packer fluid.

4. A method according to claims 1, 2, or 3 further comprising removing said coiled tubing and tool combination from said wellbore, and thereafter milling a window in said well conduit in the vicinity of said set whipstock.

5. The method according to claim 4 wherein said window is milled using said coiled tubing.

6. The method according to claim 1 wherein a weight means is employed between said jar tool and said accelerator tool to enhance said jarring impact.

7. Apparatus for setting a whipstock onto a packer in a wellbore comprising in combination an accelerator tool that both enhance and insulates against jarring impact, a jar tool carried by said accelerator tool that can be set to deliver a jarring impact, a setting tool carried by said jar tool, said setting tool carrying a shear means, and a whipstock carried by said shear means.

8. The apparatus according to claim 7 wherein said accelerator tool is carried by coiled tubing and said accelerator tool essentially insulates said coiled tubing from said jarring impact while enhancing said jarring impact on said setting tool.

9. The apparatus according to claim 8 wherein said setting tool has at least one aperture therein for fluid communication between an interior space in said setting tool and the exterior of said setting tool.

10. The apparatus according to claim 7 wherein a weight means is employed between said jar tool and said accelerator tool, and said setting tool carries at least one centralizer for centering and protecting same when in use in a well.

* * * * *